US008523639B2

(12) United States Patent
Leighton et al.

(10) Patent No.: US 8,523,639 B2
(45) Date of Patent: Sep. 3, 2013

(54) SELF CLEANING AND ADJUSTABLE SLURRY DELIVERY ARM

(75) Inventors: Jamie Stuart Leighton, Palo Alto, CA (US); Abhijit Desai, Fremont, CA (US); Douglas R. McAllister, Pleasanton, CA (US)

(73) Assignee: Applied Materials, Inc., Santa Clara, CA (US)

( * ) Notice: Subject to any disclaimer, the term of this patent is extended or adjusted under 35 U.S.C. 154(b) by 914 days.

(21) Appl. No.: 12/604,444

(22) Filed: Oct. 23, 2009

(65) Prior Publication Data

US 2010/0112917 A1 May 6, 2010

Related U.S. Application Data

(60) Provisional application No. 61/110,434, filed on Oct. 31, 2008.

(51) Int. Cl.
*B24B 57/00* (2006.01)

(52) U.S. Cl.
USPC ..... 451/446; 451/60; 451/36

(58) Field of Classification Search
USPC ..... 451/36, 60, 446, 447; 137/594
See application file for complete search history.

(56) References Cited

U.S. PATENT DOCUMENTS

| | | | | |
|---|---|---|---|---|
| 5,421,768 | A | 6/1995 | Fujiwara et al. | |
| 5,578,529 | A * | 11/1996 | Mullins | 438/692 |
| 5,804,507 | A | 9/1998 | Perlov et al. | |
| 6,156,124 | A | 12/2000 | Tobin | |
| 6,280,299 | B1 | 8/2001 | Kennedy et al. | |
| 6,283,840 | B1 * | 9/2001 | Huey | 451/288 |
| 6,482,290 | B1 | 11/2002 | Cheng et al. | |
| 6,506,098 | B1 | 1/2003 | Ho et al. | |
| 6,669,538 | B2 * | 12/2003 | Li et al. | 451/56 |
| 7,104,869 | B2 | 9/2006 | Tsai et al. | |
| 2002/0090896 | A1 * | 7/2002 | Li et al. | 451/56 |
| 2010/0048106 | A1 * | 2/2010 | Wang et al. | 451/60 |
| 2010/0096360 | A1 * | 4/2010 | Wang et al. | 216/53 |

OTHER PUBLICATIONS

Search report and written opinion for PCT/US2009/062242 dated May 24, 2010.

* cited by examiner

*Primary Examiner* — Timothy V Eley
(74) *Attorney, Agent, or Firm* — Patterson & Sheridan, LLP

(57) ABSTRACT

Embodiments of the invention provide a slurry delivery and rinse system for a chemical mechanical polishing (CMP) apparatus which is capable of self-cleaning, and which can adjustably deliver the slurry agent and rinse agent over a polishing pad. In one embodiment, the fluid delivery system has a distributed slurry delivery arm (DSDA) which contains at least one manifold, usually two or more manifolds attached to the lower surface of the delivery arm. Each DSDA manifold contains a plurality of slurry nozzles disposed along the length of the manifold. The delivery arm also contains a plurality of high pressure rinse nozzles extending from the lower surface of the delivery arm and disposed along the length of the delivery arm, parallel to each DSDA manifold. In one example, the delivery arm contains two DSDA manifolds disposed parallel to each other and a plurality of high pressure rinse nozzles disposed between the manifolds.

20 Claims, 10 Drawing Sheets

SELF CLEANING AND ADJUSTABLE SLURRY DELIVERY ARM

CROSS-REFERENCE TO RELATED APPLICATIONS

This application claims benefit of U.S. Provisional Patent Application Ser. No. 61/110,434, filed Oct. 31, 2008, which is herein incorporated by reference.

BACKGROUND OF THE INVENTION

1. Field of the Invention

Embodiments of the invention relate to an apparatus and a method for polishing of substrates, and more particularly to a slurry dispenser and rinse arm and methods for thereof.

2. Description of the Related Art

Integrated circuits are typically formed on substrates by the deposition of conductive, semi-conductive, or insulative layers. After each layer is deposited, the layer is etched to create circuitry features. As a series of layers are sequentially deposited and etched, the uppermost exposed surface of the substrate may become non-planar and requires planarization. This non-planar surface occurs when the thickness of the layers formed on the substrate varies across the substrate surface as a result of the nonuniform geometry of the circuits formed thereon. In applications having multiple patterned underlying layers, the height difference between the peaks and valleys becomes even more severe, and may be several microns.

Chemical mechanical polishing (CMP) is a planarization process which involves wetting a rotatable polishing pad with a chemical slurry containing abrasive components and mechanically polishing the front surface of the substrate against the wetted pad. The pad is mounted on a rotary platen and a rotatable substrate carrier is used to apply a downward pressure against the backside of the substrate. The polishing slurry is dispensed onto the pad through a slurry dispensing arm during polishing. The force between the carrier and the pad and their relative rotation, in combination with the mechanical and chemical effects of the slurry, serve to polish the substrate surface.

FIG. 1 depicts CMP system 10 in which a substrate 38 is held by a carrier head 46 which rotates about the central axis of the substrate 38. A circular polishing pad 40 is rotated while in contact with the bottom surface of the rotating substrate 38 being held by the carrier head 46. The rotating substrate 38 contacts the rotating polishing pad 40 in an area away from the center of the polishing pad 40. A slurry delivery arm 15 positioned above the surface of the polishing pad 40 dispenses a slurry 17, including, for example, an abrasive and at least one chemically-reactive agent, on the polishing pad 40 by way of a supply circuit 14 and 16. The slurry 17 is delivered to the center of the polishing pad 40 to chemically passivate or oxidize layers on the surface of the substrate being polished and abrasively remove or polish off select layers. A reactive agent in the slurry reacts with the film on the surface of the substrate to facilitate polishing. The interaction of the polishing pad, the abrasive particles, and the reactive agent with the surface of the substrate results in controlled polishing of the desired layers.

One problem encountered in CMP is that the slurry delivered to the polishing pad may coagulate, and along with the material being removed from the substrate, clog the grooves or other features on the pad thereby reducing the effectiveness of the subsequent polishing steps and increasing the likelihood of poor defect performance. Accordingly, rinse arms have been incorporated in some CMP systems to deliver water or rinse solutions to the pad to facilitate rinsing of the coagulated slurry and other materials from the grooves of the pad.

However, CMP systems encountered several drawbacks. First, the slurry delivery line often becomes clogged by condensed slurry inside the line. In addition, the rinse arm is usually in a fixed position over the pad therefore can only dispense to one location at a time. Still further, the rinse arm must be disposed over the center of the pad in order to deliver the rinse agent to that portion of the pad. Depending on the location of the substrate carrier head relative to the pad, rinsing of the central portion of the pad may not be accomplished unless the substrate carrier head is moved from the pad and polishing steps are discontinued.

Therefore, there exists a need to provide a slurry delivery and rinse system which is capable of self-cleaning, and which can adjustably deliver the slurry agent and rinse agent over the entire surface of the polishing pad without having to be located over the entire pad.

SUMMARY OF THE INVENTION

Embodiments of the invention provide a slurry delivery and rinse system for a chemical mechanical polishing (CMP) apparatus which is capable of self-cleaning, and which can adjustably deliver the slurry agent and rinse agent over the entire surface of the polishing pad without having to be located over the entire pad. In one embodiment, the apparatus for delivering fluids is provided which includes a delivery arm rotatably connected to a base and extending in a radial direction from the base, at least one slurry delivery line extending at least partially along the length of the delivery arm, at least one rinse agent delivery line extending at least partially along the length of the delivery arm, and a hinge assembly disposed on the delivery arm.

The apparatus may further contain at least one nozzle disposed downwardly on the delivery arm and connected to the at least one rinse agent delivery line. The at least one nozzle may be mounted at a perpendicular angle from a horizontal plane of the delivery arm. The tip of each nozzle may have an angle within a range from about 30° to about 60° relative to the horizontal plane of the delivery arm. In one example, the tip of each nozzle may have an angle of about 45°. In some examples, the manifolds and/or nozzles are made from or contain a fluorine-containing polymeric material, such as perfluoroalkoxy (PFA), fluorinated ethylene propylene (FEP), polytetrafluoroethylene (PTFE), or derivatives thereof.

In another embodiment, the apparatus for delivering fluids to a surface is provided which includes a fixed portion of a fluid delivery arm supported on a base at one end, at least one rinse agent delivery line disposed along at least a portion of the length of the fluid delivery arm, at least one slurry delivery line disposed at least partially along a portion of the length of the fluid delivery arm, and an adjustable portion of the fluid delivery arm connected to the fixed portion by a hinge. The hinge may further contain a plunger to secure the predetermined position of the delivery arm, a stopper to prevent over rotation of the delivery arm, and a hinge pin to connect the fixed block of an adjustable portion of the delivery arm to a hinge block of a fixed portion of the delivery arm. Alternatively, the hinge may further contain a fixed block connected to the adjustable portion, a hinge block connected to the fixed portion, and a hinge pin, wherein the hinge pin connects the fixed block of the adjustable portion to the hinge block of the fixed portion. The hinge may have a locking mechanism, such as a clamp, to secure the delivery arm to a particular position.

The fixed portion may contain a rotatable shaft attached to the base, at least one spacer block to extend the length of the fixed portion, at least one first valve for use with the at least one rinse agent delivery line, and a first cover covering the at least one first valve.

In other embodiments, the adjustable portion of the hinge may have at least one second valve to receive slurry from the at least one slurry delivery line, a rinsing port to receive rinse agent through the at least one rinse agent delivery line from the at least one first valve in the fixed portion, a second cover to collect moisture from the at least one second valve, at least one nozzle mounted to the lower surface of the delivery arm, at least one delivery channel for the at least one slurry agent delivery line, and at least one opening for the at least one rinse agent delivery line. In one example, the at least one first valve is a solenoid and at least one second valve is a solenoid or a T-joint valve. Moisture may be contained by an angled top surface of the second cover. Examples provide that the slurry delivering line is connected to each nozzle via a delivery channel. In one example, the delivery channel may contain a blocking stud disposed in one end of the delivery channel. Many of these aforementioned parts may be made from or contain various plastics. For example, the blocking stud may contain polyetherethylketone, the rotatable shaft may contain polypropylene, the fixed block may contain polypropylene, the hinge block may contain polyetherethylketone, and the spacer block may contain polypropylene.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of the invention and are therefore not to be considered limiting of its scope, for the invention may admit to other equally effective embodiments.

DETAILED DESCRIPTION

Embodiments of the invention provide a slurry delivery and rinse system for a chemical mechanical polishing (CMP) apparatus which is capable of self-cleaning, and which can adjustably deliver the slurry agent and rinse agent over the entire surface of the polishing pad without having to be located over the entire pad. In one embodiment, the fluid delivery system has a distributed slurry delivery arm (DSDA) which contains at least one manifold, usually two or more manifolds attached to the lower surface of the delivery arm. Each DSDA manifold contains a plurality of slurry nozzles disposed along the length of the manifold and the delivery arm. The delivery arm also contains a plurality of high pressure rinse nozzles extending from the lower surface of the delivery arm and disposed along the length of the delivery arm, parallel to each DSDA manifold. In one example, the delivery arm contains two DSDA manifolds disposed parallel to each other and a plurality of high pressure rinse nozzles disposed between the manifolds.

In another embodiment, the DSDA manifolds distribute slurry to the pad or substrate from the slurry nozzles extending from the manifolds during a polishing process. Water or another rinse agent may be delivered to the pad from the high pressure rinse nozzles during a rinse process. Subsequently, the water or rinse agent may be diverted by a valve, and instead of passing through the high pressure rinse nozzles, the water or other rinse agent may pass through the slurry nozzles. In one example, the water or rinse agent is diverted by a non-return valve or one-way valve disposed at one end of a T-joint fitting coupled between the rinse agent delivery line, the slurry delivery line, and the source of the rinse agent. Alternatively, a three-way valve may be used of the non-return valve and T-joint fitting. The water or other rinse agent removes any residues, particulate, or other contaminants within the DSDA manifold and the slurry nozzles.

In other embodiments, the adjustable delivery arm which is rotatably mounted adjacent the surface to which it is intended to deliver the rinse agent and/or slurry. This position provides easy access to the surface for replacement and or other maintenance. Additionally, sweeping nozzles may be disposed on the fluid delivery system, specifically on the delivery arm. The sweeping nozzles may be used to direct rinse agent and debris toward and off the edge of the surface being cleaned.

Figure 1:
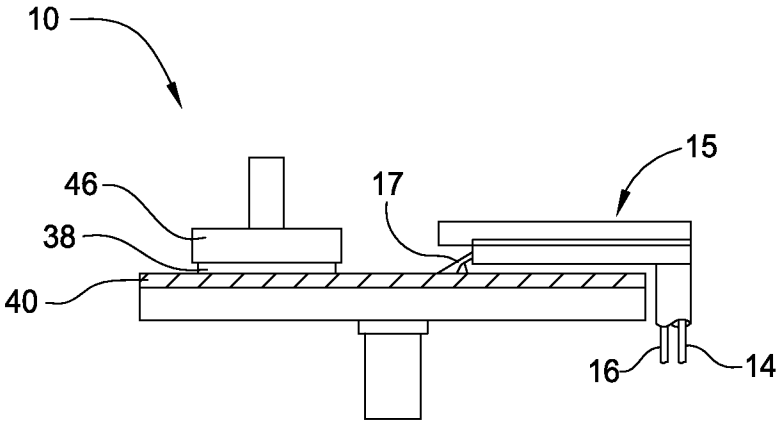
FIG. 1 ( PRIOR ART )
FIG. 1 depicts a side view of a chemical mechanical polishing apparatus known in the art.
Figure 2:
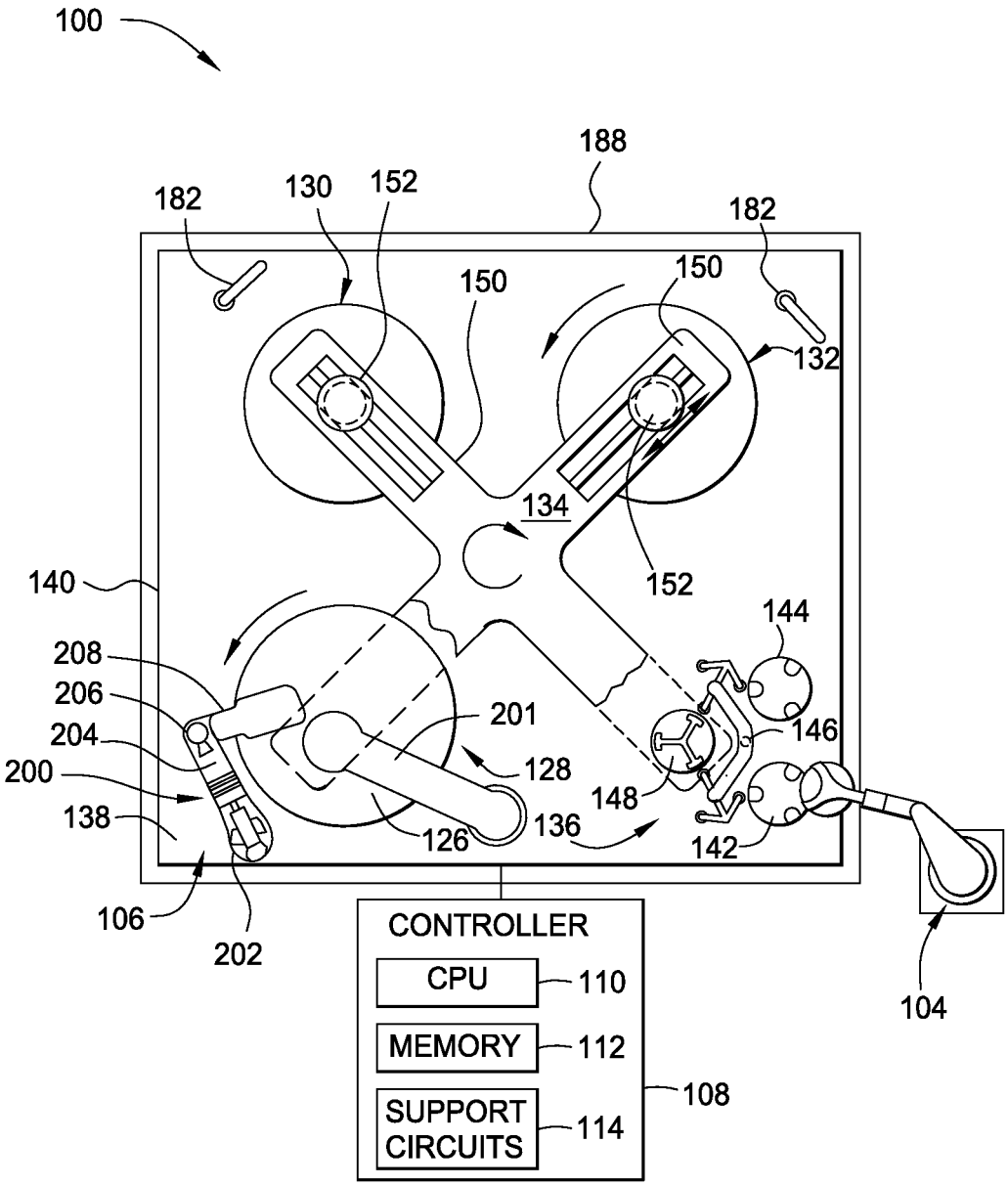
FIG. 2 depicts a chemical mechanical polishing system containing fluid delivery system, as described in one embodiment herein.

FIG. 2 depicts a plan view of a chemical mechanical polishing (CMP) system 100 as described in an embodiment herein. The exemplary CMP system 100 generally comprises a factory interface, a loading robot 104, and a polishing module 106. The loading robot 104 is disposed proximate the factory interface and the polishing module 106 to facilitate the transfer of substrates 122 therebetween.

A controller 108 is provided to facilitate control and integration of the modules of the system 100. The controller 108 comprises a central processing unit (CPU) 110, a memory 112, and support circuits 114. The controller 108 is coupled to the various components of the CMP system 100 to facilitate control of, for example, the polishing, cleaning, and transfer processes.

The polishing module 106 includes at least a first CMP station 128, disposed in an environmentally controlled enclosure 188. The fluid delivery systems, as described herein, may be used in the CMP systems, such as, the MIRRA® CMP system, the MIRRA MESA® CMP system, the MIRRA® TRAK CMP system, and the MIRRA® DNS CMP system available from Applied Materials, Inc., located in Santa Clara, Calif. Other polishing modules, including those that use processing pads, polishing webs, or a combination thereof, and those that move a substrate relative to a polishing surface in a rotational, linear or other planar motion may also be adapted to benefit from the invention.

In the embodiment depicted in FIG. 2, the polishing module 106 includes one bulk CMP station 128, a second CMP station 130 and a third CMP station 132. Bulk removal of conductive material from the substrate is performed through an electrochemical dissolution process at the bulk CMP station 128. After the bulk material removal at the bulk CMP station 128, residual conductive material is removed from the substrate at the residual CMP station 130 through a second electrochemical mechanical process. It is contemplated that more than one residual CMP station 130 may be utilized in the polishing module 106. A CMP process may be performed at the polishing station 132 after processing at the residual CMP station 130 by the barrier removal process described herein. Further disclosure of CMP processes for barrier removal is described in U.S. Pat. No. 7,104,869, which is incorporated by reference in its entirety. Each of the first and second CMP stations 128 and 130 may be utilized to perform both the bulk and multi-step conductive material removal on a single station. It is also contemplated that all CMP stations (for example 3 stations of the module 106 depicted in FIG. 2) may be configured to process the conductive layer with a two step removal process.

The exemplary polishing module 106 also includes a transfer station 136 and a carousel 134 that are disposed on an upper or first side 138 of a machine base 140. In one embodiment, the transfer station 136 includes an input buffer station 142, an output buffer station 144, a transfer robot 146, and a load cup assembly 148. The input buffer station 142 receives substrates from a factory interface by means of the loading robot 104. The loading robot 104 is also utilized to return polished substrates from the output buffer station 144 to the factory interface. The transfer robot 146 is utilized to move substrates between the buffer stations 142, 144 and the load cup assembly 148. In one example, the two transfer stations 144 and 146 are used with 200 mm diameter substrates. However, in another example, only one transfer station, such as transfer station 142, is used with 300 mm diameter substrates.

In one embodiment, the transfer robot 146 includes two gripper assemblies (not shown), each having pneumatic gripper fingers that hold the substrate by the edge of the substrate. The transfer robot 146 may simultaneously transfer a substrate to be processed from the input buffer station 142 to the load cup assembly 148 while transferring a processed substrate from the load cup assembly 148 to the output buffer station 144. An example of a transfer station that may be used to advantage is described in U.S. Pat. No. 6,156,124, which is herein incorporated by reference in its entirety.

The carousel 134 is centrally disposed on the base 140. The carousel 134 typically includes a plurality of arms 150, each supporting a polishing head assembly 152. Two of the arms 150 depicted in FIG. 2 are shown in phantom such that the transfer station 136 and a polishing surface 126 of the first CMP station 128 may be seen. The carousel 134 is indexable such that the polishing head assemblies 152 may be moved between the polishing stations 128, 130, 132 and the transfer station 136. One carousel that may be utilized to advantage is described in U.S. Pat. No. 5,804,507, which is hereby incorporated by reference in its entirety.

Conditioning devices 182 may be disposed on the base 140 adjacent each of the polishing stations 130 and 132, as depicted in FIG. 2. The conditioning devices 182 may be used to periodically supplement the polishing solutions at the stations 130 132 to maintain uniform polishing results. In an alternative embodiment, the conditioning devices 182 may be replaced with additional fluid delivery systems and/or arms, such as fluid delivery system 200 containing a distributed slurry delivery arm (DSDA) 202, as well as a pad conditioning arm 201.

Figure 3A:
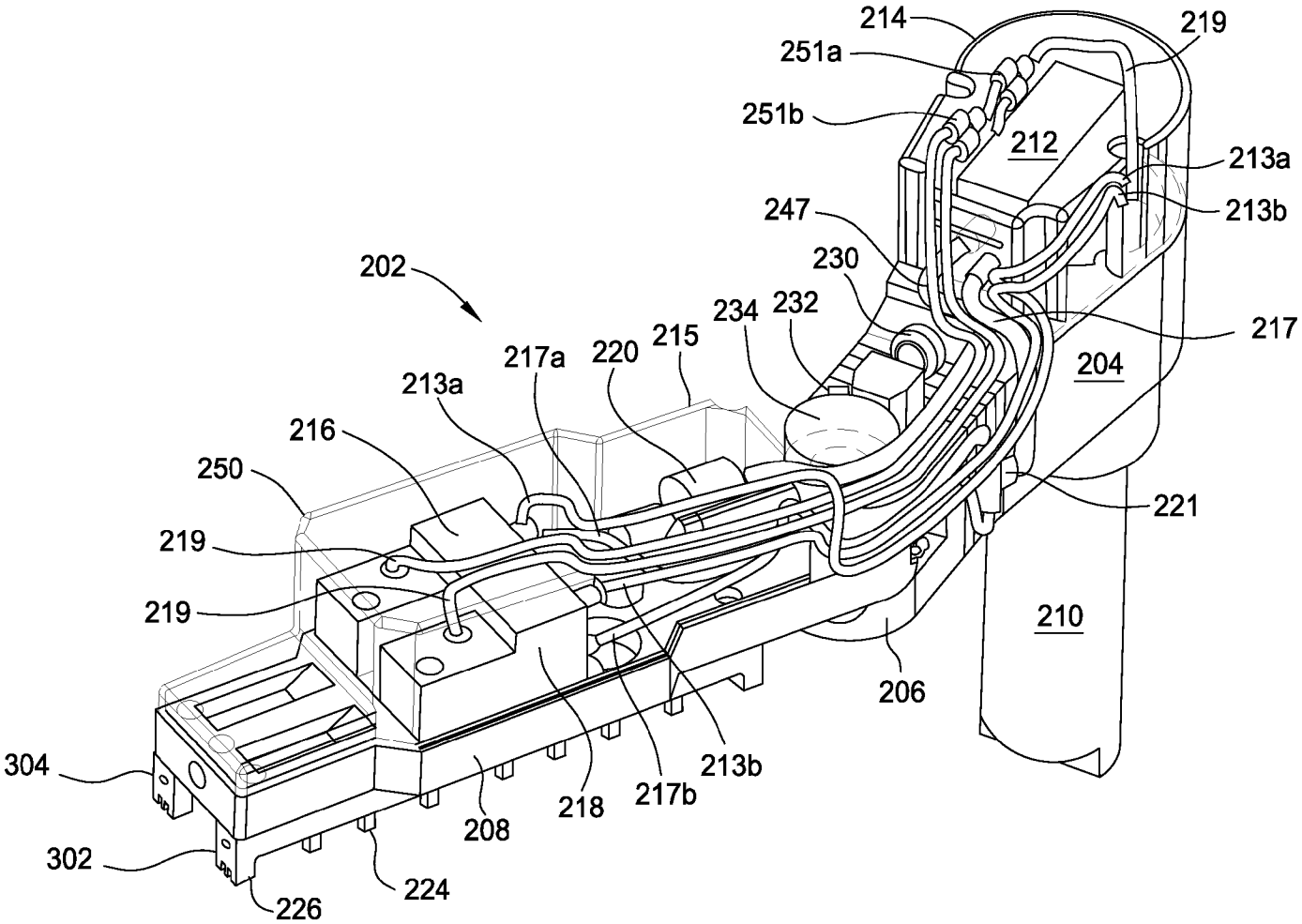
FIGS. 3A-3C depict schematic views of a delivery arm according to embodiments described herein.
Figure 3B:
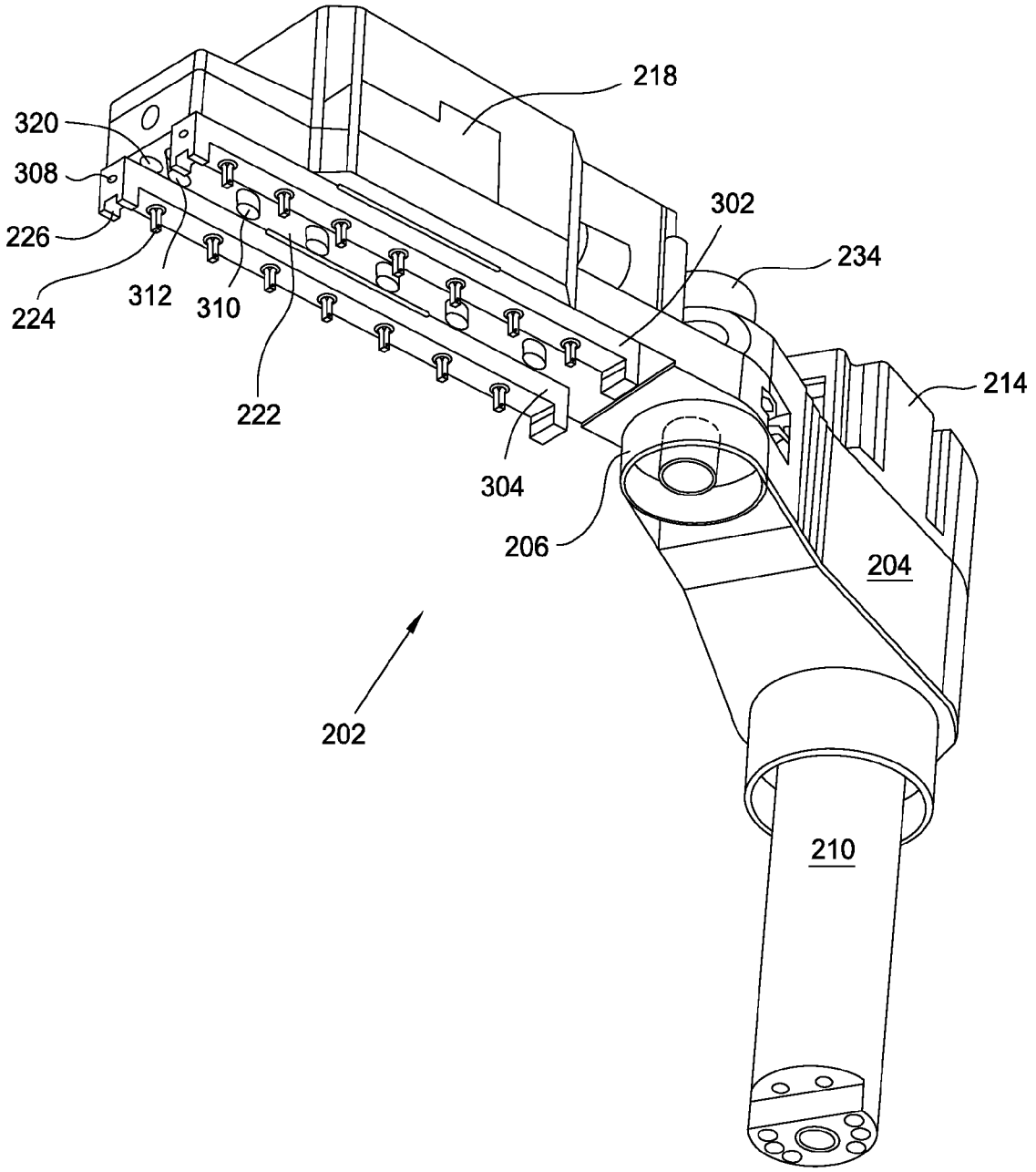
Figure 3C:
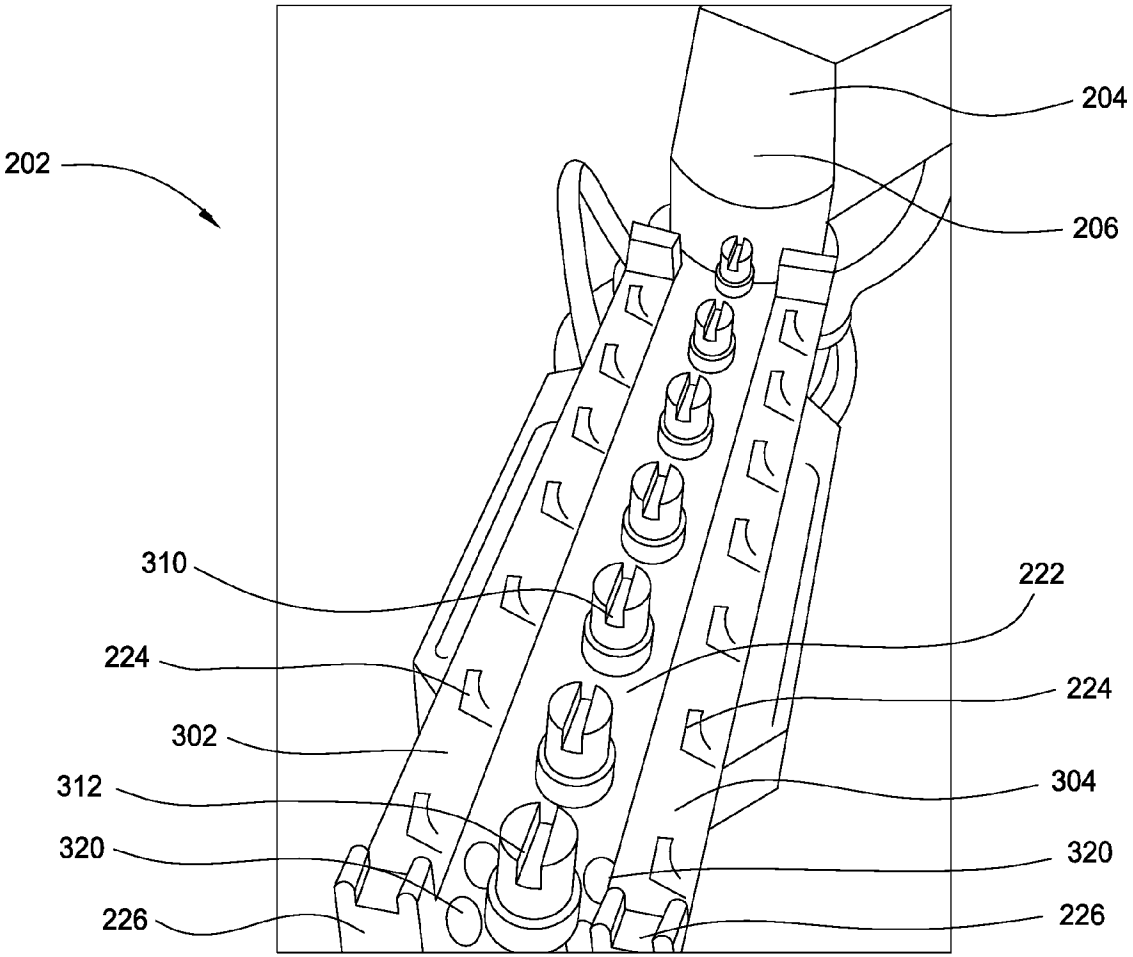

FIGS. 3A-3C depict schematic views of the delivery arm 202 used in the fluid delivery system 200 according to embodiments herein. The delivery arm 202 has a fixed portion 204 and an adjustable portion 208, both connected to a hinge assembly 206. The adjustable portion 208 may be moved to different locations of the pad or substrate by turning the hinge assembly 206. The fixed portion 204 is mounted on a shaft 210 to enable rotation of the delivery arm 202 between a processing position over the polishing pad and a maintenance position adjacent the pad. The delivery arm 202 is generally angled along its length from its fixed portion 204 to its adjustable portion 208. The delivery arm 202 may be adjustable to different angles according to process specifications through the use of the hinge assembly 206.

In one embodiment, the shaft 210 may contain or be made of polypropylene. The cover 214 may contain or be made of nylon. The hinge assembly 206, which includes a plunger 230, a stopper 232, and a hinge pin 234, uses a locking mechanism to connect the fixed portion 204 to the adjustable portion 208. The hinge assembly 206 allows the adjustable portion 208 to be turned and set to a desired position so that the position for slurry delivery may be adjusted according to pad size, location, or process parameters.

In one embodiment, the delivery arm 202 contains at least one manifold, usually two or more manifolds attached to the underside or lower surface 222 of the delivery arm 202. FIGS. 3A-3C depict the delivery arm 202 having manifolds 302 and 304. Both manifolds 302 and 304 have a plurality of slurry nozzles 224 disposed along the length of each other and extending away from the delivery arm 202 and towards the polishing pad. The delivery arm 202 also contains a plurality of high pressure rinse nozzles 310 and 312 extending away from the lower surface 222 of the delivery arm 202 towards the polishing pad. The plurality of high pressure rinse nozzles 310 and 312 are disposed along the length of the delivery arm 202 in a line which extends parallel to and between the manifolds 302 and 304, as depicted in FIGS. 3B-3C.

High pressure rinse nozzle 312 is disposed at the end of the adjustable portion 208 of the delivery arm 202, opposite of the fixed portion 204. High pressure rinse nozzle 312 may be adjusted or pivoted to spray rinsing agent at a wide range of angles. Delivery arm 202 may also contain a plurality of outlets 320 disposed on the lower surface 222. The outlets may be at the end of the adjustable portion 208 of the delivery arm 202 in the vicinity of high pressure rinse nozzle 312. In one example, high pressure rinse nozzle 312 may be disposed between four outlets 320 at the end of the adjustable portion 208, as depicted in FIG. 3C.

In another embodiment, the fixed portion 204 of the delivery arm 202 includes a valve or solenoid 212 enclosed by the cover 214, as depicted in FIG. 3A. The solenoid 212 is located on the fixed portion 204 and coupled to and in fluid communication with tubing throughout the delivery arm 202. The solenoid 212 may be used to deliver rinsing agents such as deionized water.

In another embodiment, the delivery arm 202 may have one, two, or more slurry delivery lines mounted on or disposed within the delivery arm 202. Usually, the delivery arm 202 contains a slurry delivery line for each DSDA manifold contained thereon. FIG. 3A depicts slurry delivery lines 213*a* and 213*b* coupled to and in fluid communication with valves or solenoids 216 and 218 positioned on the adjustable portion 208. The other ends of the slurry delivery lines 213*a* and 213*b* may be coupled to and in fluid communication with the same or different source, such as a slurry reservoir. The solenoids 216 and 218 are independently two-way valves which are capable of two-way flowing.

In other embodiments, the manifolds 302 and 304 distribute slurry to the pad or substrate from the nozzles 224 and end nozzles 226 extending from the manifolds 302 and 304 during a polishing process. Water or another rinse agent may be delivered to the pad from the high pressure rinse nozzles 310 and 312 during a rinse process. Subsequently, the water or rinse agent may be diverted by solenoids 216 and 218 or another two-way valve, and instead of passing through the high pressure rinse nozzles 310 and 312, the water or other rinse agent may pass through the nozzles 224 and end nozzles 226. In one example, the water or rinse agent is diverted by the solenoids 216 and 218. In another example, the water or rinse agent is diverted by a non-return valve or one-way valve disposed at one end of a T-joint fitting coupled between the rinse agent delivery line, the slurry delivery line, and the source of the rinse agent. Alternatively, a two-way valve or a three-way valve may is used to divert the water or rinse agent to the nozzles 224 and end nozzles 226, instead of flowing through the high pressure rinse nozzles 310 and 312. The water or other rinse agent removes any residues, particulate, or other contaminants within the DSDA manifold and the slurry nozzles.

In one embodiment, the T-joint fitting 221 may be connected to the solenoid 212 on the fixed portion 204 for cleaning purposes. Rinse agent, such as deionized water, may flow from line 217, through the T-joint fitting 221, and to the rinse agent delivery lines 217*a* and 217*b* for cleaning and rinsing the debris within the slurry delivery line. In another embodiment, tubing may be used as the slurry delivery lines and one or more slurries are pumped from one or more slurry sources using a diastolic pump or some other type of pump through the end of the tubing. A central rinse agent delivery line 217 is coupled between the solenoid 212 and the T-joint fitting 221. A rinsing port 220 is located on the adjustable portion 208 and receives the rinse agent through the rinse agent delivery line 247 from the solenoid 212 and delivers one or more rinse agents to a plurality of nozzles 224 and an end nozzle 226 mounted to the lower surface 222 of the delivery arm 202.

The adjustable portion 208 includes a cover 215 which collects the moisture coming out of the solenoids 216 and 218 and prevents the moisture from leaking. The cover 215 may contain or be made of nylon. The top surface 250 of the cover 215 may be sloped at an angle to prevent moisture settlement. The adjustable portion 208 preferably terminates at a position short of the center of where the carrier are being held to allow the carrier holding the substrate to move radially across or even over the center of the carrier holder (not shown) during polishing without the risk of having the delivery arm 202 collide with the carrier.

Each nozzle 224 and end nozzle 226 are disposed on the adjustable portion 208 of the delivery arm 202 at an angle to the plane of the delivery arm 202 to deliver one or more rinse agents. Alternatively, the delivery arm 202 may be set to a desired angle extending over the center of the pad and a nozzle 224 or end nozzle 226 is disposed at or near the distal end of the delivery arm 202 to deliver rinse agent to the central portion of the pad. In one embodiment, the rinsing agent is delivered at a pressure within a range from about 15 pounds per square inch (psi) to about 100 psi, preferably, from about 30 psi to about 40 psi. In another embodiment, such as when using a hose, the slurry agent is delivered at a pressure within a range from about 1 psi to about 10 psi, preferably, from about 3 psi to about 4 psi.

Figure 4A:
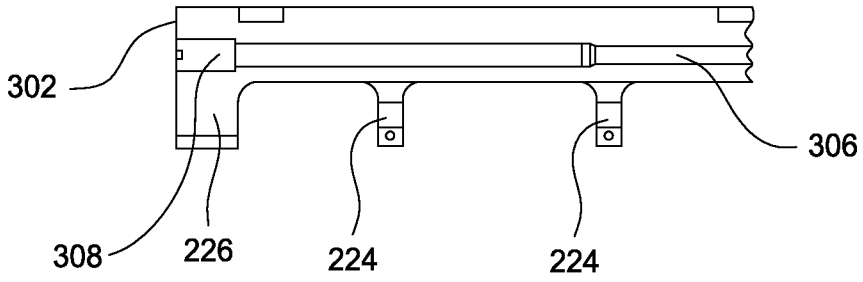
FIGS. 4A-4B depict a series of nozzles disposed on the lower surface of the delivery arm according to embodiments described herein.
Figure 4B:
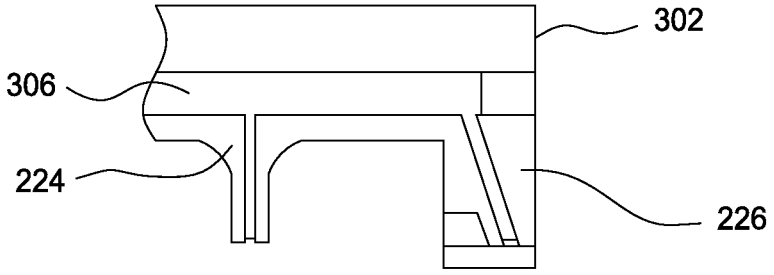

FIG. 3A depicts the delivery arm 202 having a plurality of nozzles 224 and an end nozzle 226 mounted on the lower surface 222 of the delivery arm 202. The plurality of nozzles 224 and end nozzle 226 may be used for dispersing the rinse agent and/or slurry to the surface of a substrate or pad. The slurry in the slurry delivery lines 213*a* and 213*b* and the rinse agent in the rinse agent delivery lines 217*a* and 217*b* may be delivered to the nozzles 224 and end nozzles 226 by using delivery channel 306 contained within the DSDA manifolds, as shown in FIGS. 4A-4B. The manifolds 302 and 304 contain delivery channel 306 along its length which terminates at the adjustable portion 208. The solenoids 216 and 218 connected to the slurry delivery lines may contain a 2-way valve which allows both the slurry agent and rinse agent to flow through the delivery channel 306 for slurry delivery and for cleaning purposes. A blocking stud 308 may be disposed in one end of the delivery channel 306. The blocking stud 308 may have different lengths and be used for blocking nozzles depending on the size of the carrier holder. In one embodiment, the delivery channel 306 may be machined channels or may be tubing disposed through and secured in each of the shafts and the arms. In another embodiment, the blocking stud 308 may contain or be made from polyetherethylketone (PEEK).

As shown in FIGS. 3A-3C and 4A-4B, each manifold 302 and 304 has a plurality of nozzles 224 and end nozzle 226. The manifolds 302 and 304 are disposed on the lower surface 222 of the delivery arm 202 and are connected to the rinse agent delivery line. In one embodiment, the series of nozzles 224 and end nozzle 226 are attached along the length of the arm. An end nozzle 226, as shown in FIGS. 4A-4B, is disposed at an angle relative to the plane of the delivery arm 202, e.g., an acute angle, to deliver a fluid a distance away from the adjustable portion 208 of the delivery arm 202 towards the central portion of the pad. Each end nozzle 226 is positioned to deliver fluid outwardly beyond the end of the delivery arm 202 to cover the remaining pad regions, including the central portion of the pad, while also overlapping the spray from the adjacent nozzles. Therefore, each region of the pad is exposed to the spray coming from the delivery arm 202. While in some examples, the spray patterns overlap, in other examples, each spray pattern does not overlap adjacent patterns. In one example, the delivery arm 202 contains two delivery channels 306, each coupled to and in fluid communication with at least six nozzles 224 and one end nozzle 226, as depicted in FIGS. 3A-3C.

In another embodiment, the delivery arm 202 may have one, two, or more gas lines mounted on or disposed within the delivery arm 202. The gas line 219 may be used to flow compressed air or other gases for controlling solenoids, such as valves 212, 216, and 218. In one example, the gas line 219 is coupled to Y-fitting 251*a*, and extends to solenoid 212 and to Y-fitting 251*b*. The gas line 219 further extends from Y-fitting 251*b* to solenoids 216 and 218.

Figure 5A:
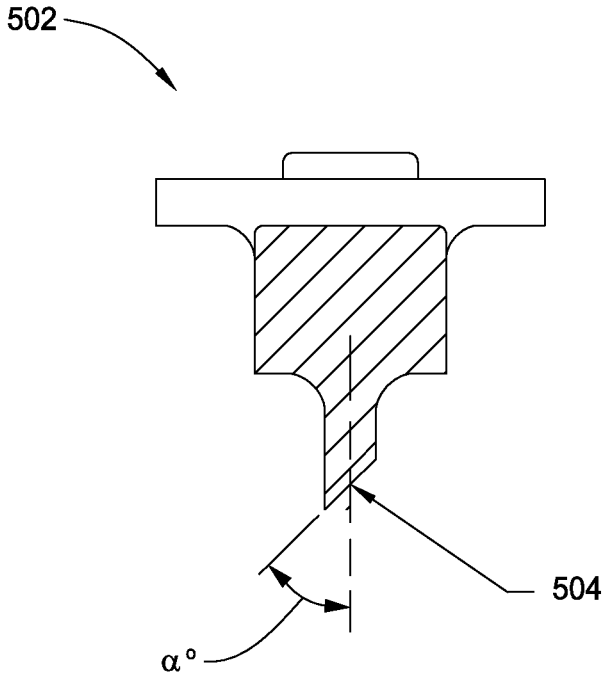
FIGS. 5A-5B depict cross sectional views of nozzles on a manifold according to embodiments described herein.
Figure 5B:
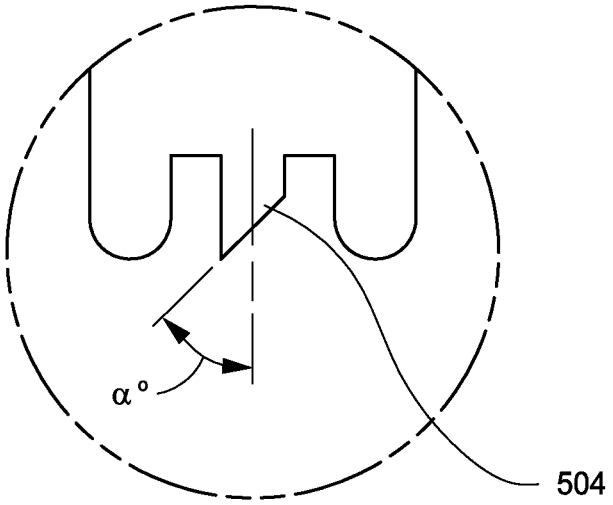

FIGS. 5A-5B depict cross sectional views of a nozzle 502 according to other embodiments. The nozzle 502 may be mounted on the delivery arm 202 at a perpendicular angle relative to a plane extending the length of the delivery arm 202. FIG. 5A depicts the nozzle 502 connected to a slurry delivery line via a tubing where the fluid is being delivered, and is dispensed from the tip 504 of the nozzle 502. In one embodiment, the tip 504 of the nozzle 502 may be a fine tipped nozzle. In another embodiment, the tip 504 of the nozzle 502 may have an angle $\alpha$ to prevent fluid from clogging the line through the opening of the nozzle 502 as shown in FIGS. 5A-5B. In another embodiment, the angle $\alpha$ of the tip 504, relative to the horizontal plane of the delivery arm 202, may be within a range from about 20° to about 75°, preferably, from about 30° to about 60°, and more preferably, from about 40° to about 50°, for example, about 45°. The nozzle 502 may contain or be made of fluorine-containing polymers, such as perfluoroalkoxy (PFA), fluorinated ethylene propylene (FEP), or polytetrafluoroethylene (PTFE), commercially available as TEFLON® from DuPont. In another example, the tip 504 of the nozzle 502 may be drilled by laser vertically so that the inner surface of the hole is smooth and does not provide rough edges for nucleation of the slurry.

Figure 6A:
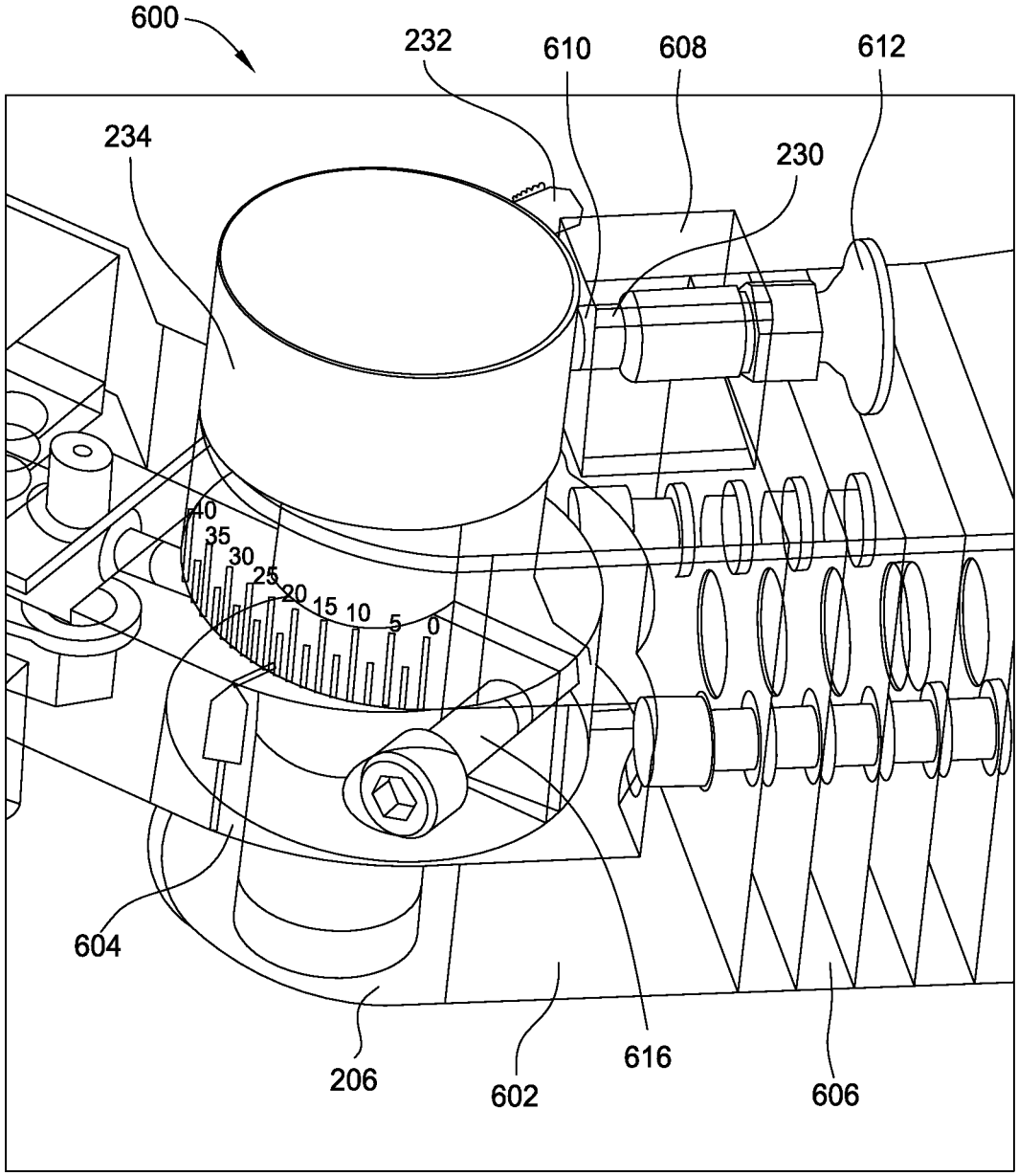
FIGS. 6A-6B depict schematic views of a delivery arm containing a hinge according to another embodiment described herein.
Figure 6B:
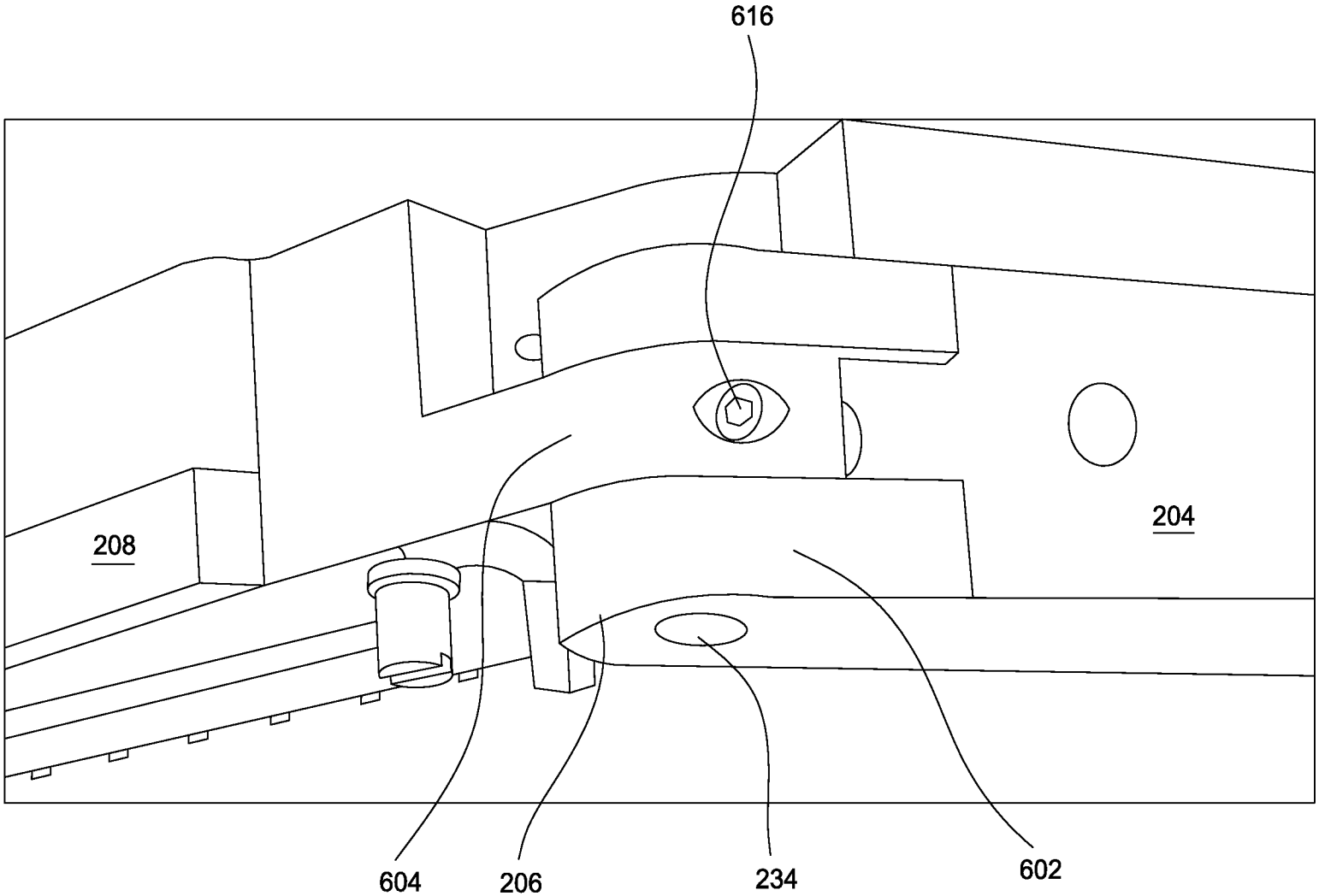

FIGS. 6A-6B illustrate schematic views of hinge assembly 206, connected to and between the fixed portion 204 and adjustable portion 208 of the delivery arm 202, as described in several embodiments herein. FIG. 6A depicts a schematic view of hinge assembly 206 containing clutch assembly 600 as used in the delivery arm 202, according to one embodiment. FIG. 6B depicts hinge assembly 206 without a clutch assembly, according to another embodiment.

The hinge assembly 206 may include a plunger 230, a stopper 232 and a hinge pin 234, and uses a locking mechanism to connect the fixed portion 204 of the delivery arm 202 to the adjustable portion 208 of the delivery arm 202. The locking mechanism on hinge assembly 206 may be a clamp 616, such as a vice-type clamp, a C-clamp, or a screw clamp. The fixed portion 204 includes a hinged block 602, which may be fitted with a fixed block 604 connected to the adjustable portion 208. The hinged block 602 and the fixed block 604 may be secured together by the hinge pin 234. The hinge pin 234 allows the adjustable portion 208 of the delivery arm 202 to rotate and adjust to the position setting of the adjustable portion 208 according to the size and position of the pad.

In one embodiment, degree markings may be engraved onto the outer surface of the hinged block 602. The hinged block 602 and the fixed block 604 may contain or be made of polypropylene. The hinge pin 234 may contain or be made of polyetherethylketone (PEEK). To lengthen the delivery arm 202 to reach a desired position, spacer block 606 may be positioned between the hinged block 602 and the fixed portion 204.

In another embodiment, the number of spacer blocks 606 may be adjusted according to the length needed to reach the desired position, as depicted in FIG. 6A. In another example, the spacer block 606 may contain or be made polypropylene. To secure the position setting of the adjustable portion 208, the plunger 230 may be used to exert pressure onto the hinge pin 234 while securing the position setting of the adjustable portion 208. The plunger 230 may be placed inside a covered box 608 with one end 610 of the plunger 230 pushing against the hinged block 602, and the other end 612 of the plunger 230 exposed outside the box.

In one example, the plunger 230 may be a spring loaded plunger. The plunger 230 may contain or be made from steel, stainless steel, aluminum, alloys thereof, or other metals. To secure the position setting, the adjustable portion 208 may be set to a position as illustrated by the degree markings, pressure is then applied to the hinge pin 234 by rotating end 612 of the plunger 230 toward the hinge pin 234 and therefore tightening the end 610 of the plunger 230 against the hinge pin 234. To prevent over-rotation from position setting, a stopper 232 is located on the hinge pin 234 to stop the rotation of the adjustable portion 208. The hinge assembly 206 may have a locking mechanism or a clamp 616, such as a vice-type clamp, a C-clamp, or a screw clamp.

The delivery arm 202, the fixed portion 204, adjustable portion 208 and/or portions thereof may contain or be made of a rigid material, such as polypropylene, which is chemically inert to polishing slurries and solutions. The manifolds 302 and 304, the nozzles 224, and end nozzle 226, as well as, the slurry delivery lines may contain or be made from tubing containing fluorine-containing polymers, such as perfluoroalkoxy (PFA), fluorinated ethylene propylene (FEP), or polytetrafluoroethylene (PTFE), which commercially available as TEFLON® from DuPont, which is not reactive with the various slurries used in the CMP processes.

Figure 7:
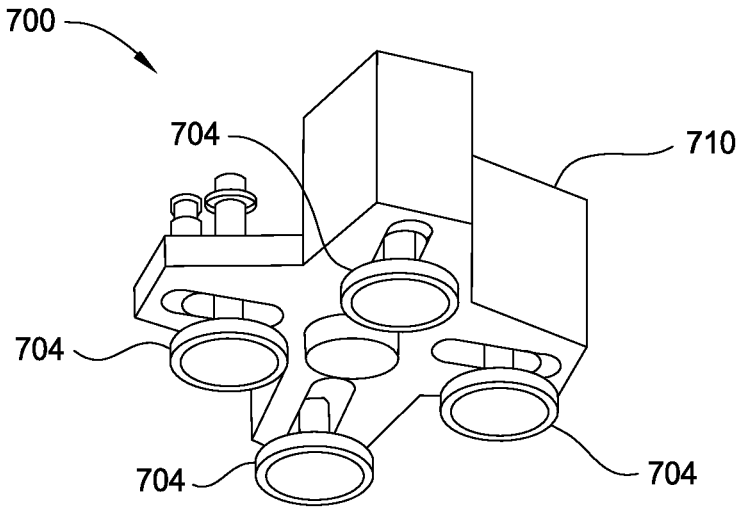
FIG. 7 depicts a multi-pad system according to an embodiment described herein.
Figure 7:
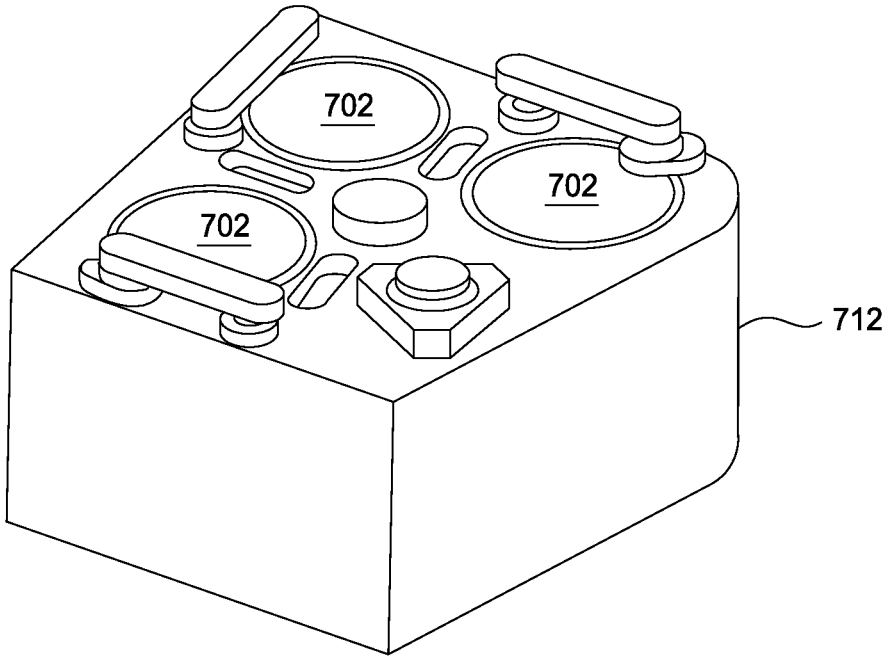

FIG. 7 depicts a multi-pad system 700 representative of the MIRRA® CMP system, available from Applied Materials, Inc. located in Santa Clara, Calif. The multi-pad system 700 has an upper assembly 710 and a lower assembly 712. Typically, a substrate is positioned or chucked to a carrier head which positions a substrate on the polishing pad and confines the substrate on the pad. The polishing pad 702 is typically rotated and the substrate may also be rotated within the carrier 704. Additionally, the carrier may be moved radially across the surface of the polishing pad to enhance uniform polishing of the substrate surface.

Once the substrate is located in the carrier and the carrier is located over the polishing pad, a solution or slurry is typically delivered to the polishing pad by the delivery arm 202, as depicted in FIGS. 2 and 3A-3C. The slurry may contain abrasive particles and chemical reagents, such as sodium hydroxide, or may just be deionized water if used on a rinse pad. The carrier is then lowered over the polishing pad so that the substrate contacts the pad and the substrate surface is then polished according to a pre-selected recipe. Towards the end of the polishing step, a rinse agent, such as deionized water, may be delivered to the pad via the nozzles 224 and end nozzles 226 on the adjustable portion to rinse the polishing pad and the substrate. In one example, the rinse agent may be delivered to the polishing pad for a period within a range from about 5 seconds to about 20 seconds. During which time the substrate is raised from the polishing pad 702 and the carrier 704 is moved either to the next processing position in multiple polishing pad systems and/or into position for unloading the substrate and loading the next substrate for processing. Periodically, the rinse agent may also be delivered to the slurry delivery line to rinse out the debris that is still adhered within the slurry delivery line thereby achieving the self-cleaning purpose.

While the foregoing is directed to embodiments of the invention, other and further embodiments of the invention may be devised without departing from the basic scope thereof, and the scope thereof is determined by the claims that follow.

The invention claimed is:

1. An apparatus for delivering fluids to a surface of a substrate or a pad, comprising:

a delivery arm rotatably connected to a base that is rotatable about a stationary shaft, the delivery arm extending from the base;

at least one slurry delivery line coupled to and extending at least partially along the length of the delivery arm;

at least one rinse agent delivery line coupled to and extending at least partially along the length of the delivery arm;

a hinge disposed on the delivery arm, the hinge comprising a locking mechanism for securing the delivery arm in a predetermined position; and at least one nozzle mounted at a perpendicular angle from a horizontal plane of the delivery arm, connected to the at least one rinse agent delivery line, and disposed downwardly from the delivery arm.

2. The apparatus of claim 1, wherein a tip of the nozzle has an angle within a range from about 30° to about 60° relative to the horizontal plane of the delivery arm.

3. The apparatus of claim 2, wherein the angle is about 45°.

4. The apparatus of claim 1, wherein the at least one nozzle comprises a fluorine-containing polymeric material.

5. The apparatus of claim 4, wherein the fluorine-containing polymeric material comprises a material selected from the group consisting of perfluoroalkoxy (PFA), fluorinated ethylene propylene (FEP), polytetrafluoroethylene (PTFE), and derivatives thereof.

6. The apparatus of claim 5, wherein the hinge further comprises:

a plunger to secure the predetermined position of the delivery arm;

a stopper to prevent over rotation of the delivery arm; and a hinge pin to connect the fixed block of an adjustable portion of the delivery arm to a hinge block of a fixed portion of the delivery arm.

7. An apparatus for delivering fluids to a surface, comprising:

a fixed portion of a fluid delivery arm supported on a base at one end;

at least one rinse agent delivery line coupled to and disposed along at least a portion of the length of the fluid delivery arm;

at least one slurry delivery line coupled to and disposed at least partially along a portion of the length of the fluid delivery arm; and an adjustable portion of the fluid delivery arm connected to the fixed portion by a hinge, the hinge further comprising:

a fixed block connected to the adjustable portion;

a hinge block connected to the fixed portion; and a hinge pin coupled between the fixed block of the adjustable portion and the hinge block of the fixed portion.

8. The apparatus of claim 7, wherein the hinge comprises a locking mechanism to secure the delivery arm to a particular position.

9. The apparatus of claim 8, wherein the fixed portion further comprises:

a rotatable shaft attached to the base;

at least one spacer block to extend the length of the fixed portion;

at least one first valve for use with the at least one rinse agent delivery line; and a first cover covering the at least one first valve.

10. The apparatus of claim 9, wherein the adjustable portion further comprises:

at least one second valve coupled to the at least one slurry delivery line;

a rinsing port coupled to the at least one rinse agent delivery line from the at least one first valve in the fixed portion;

a second cover coupled to the at least one second valve;

at least one nozzle mounted to the lower surface of the delivery arm; and at least one delivery channel coupled to the at least one slurry agent delivery line.

11. The apparatus of claim 10, wherein the at least one first valve is a solenoid and the at least one second valve is a solenoid or a T-joint valve.

12. The apparatus of claim 11, wherein the second cover has an angled top surface.

13. The apparatus of claim 12, wherein the at least one slurry delivering line is connected to the at least one nozzle via a delivery channel.

14. The apparatus of claim 13, wherein the delivery channel comprises a blocking stud disposed in one end of the delivery channel.

15. The apparatus of claim 14, wherein the blocking stud comprises polyetherethylketone, the rotatable shaft comprises polypropylene, the fixed block comprises polypropylene, the hinge block comprises polyetherethylketone, and the at least one spacer block comprises polypropylene.

16. An apparatus for delivering fluids to a surface of a substrate or a pad, comprising:

a delivery arm rotatably connected to a base and extending from the base;

a first fluid manifold connected to a lower surface of the delivery arm and comprising a first plurality of slurry nozzles;

a first slurry delivery line extending at least partially along the length of the delivery arm and in fluid communication with the first fluid manifold;

at least one rinse agent delivery line extending at least partially along the length of the delivery arm;

a plurality of rinse nozzles extending from the lower surface of the delivery arm and in fluid communication with the rinse agent delivery line; and a first two-way valve coupled to and in fluid communication with the first fluid manifold, the first slurry delivery line, and the rinse agent delivery line.

17. The apparatus of claim 16, further comprising:

a second fluid manifold connected to the lower surface of the delivery arm and comprising a second plurality of slurry nozzles;

a second slurry delivery line extending at least partially along the length of the delivery arm and in fluid communication with the second fluid manifold; and a second two-way valve coupled to and in fluid communication with the second fluid manifold, the second slurry delivery line, and the rinse agent delivery line.

18. The apparatus of claim 17, wherein the plurality of rinse nozzles comprises high pressure rinse nozzles.

19. The apparatus of claim 18, wherein the rinse nozzles are disposed on the lower surface of the delivery arm and are parallel to the first fluid manifold.

20. The apparatus of claim 19, wherein the plurality of rinse nozzles are disposed on the lower surface of the delivery arm between the first and second fluid manifolds.

* * * * *